US006012653A

United States Patent [19]

Gunther et al.

[11] Patent Number: 6,012,653

[45] Date of Patent: Jan. 11, 2000

[54] MODULAR ABRASIVE MEDIUM WATER JET CUTTING HEAD

[75] Inventors: Ulrich Gunther, Meissen; Lutz Lemmin, Dresden; Rainer Strehle, Wilthen; Harry Thonig, Neukirch, all of Germany

[73] Assignee: Sachsische Werkzeug und Sondermaschinen, Neukirch, Germany

[21] Appl. No.: 09/077,903

[22] PCT Filed: Oct. 4, 1997

[86] PCT No.: PCT/DE97/02290

§ 371 Date: Jun. 4, 1998

§ 102(e) Date: Jun. 4, 1998

[87] PCT Pub. No.: WO98/15385

PCT Pub. Date: Apr. 16, 1998

[30] Foreign Application Priority Data

Oct. 4, 1996 [DE] Germany ..... 196 40 921

[51] Int. Cl.[7] ..... B05B 7/04

[52] U.S. Cl. ..... 239/434; 239/432; 239/433

[58] Field of Search ..... 239/432, 433, 239/434, 590.5, 593, 594, 595, 591, 430, 431; 451/102

[56] References Cited

U.S. PATENT DOCUMENTS

| | | | |
|---|---|---|---|
| 4,449,332 | 5/1984 | Griffiths . | |
| 4,478,368 | 10/1984 | Yie . | |
| 4,523,988 | 6/1985 | Hedrick, II . | |
| 4,704,826 | 11/1987 | Kirkland | 451/102 |
| 4,872,293 | 10/1989 | Yasukawa et al. . | |
| 5,018,670 | 5/1991 | Chalmers . | |
| 5,551,909 | 9/1996 | Bailey . | |
| 5,794,858 | 8/1998 | Munoz | 239/433 |

FOREIGN PATENT DOCUMENTS

| | | |
|---|---|---|
| 0-276-750 | of 0000 | European Pat. Off. . |
| 0-502-461 | of 0000 | European Pat. Off. . |
| 0110529 | 6/1984 | European Pat. Off. . |
| 221236 A1 | 5/1987 | European Pat. Off. . |
| 437168 A2 | 7/1991 | European Pat. Off. . |
| 2928698 | of 0000 | Germany . |
| 3516 103A1 | of 0000 | Germany . |
| 3708 608A1 | of 0000 | Germany . |
| 3844 344A1 | of 0000 | Germany . |
| 4005 691A1 | of 0000 | Germany . |
| 42-35-828 | of 0000 | Germany . |
| 43 13 704A1 | of 0000 | Germany . |
| 89-14-626 | of 0000 | Germany . |
| 940296.91 | of 0000 | Germany . |
| WO-88/01206 | of 0000 | WIPO . |

*Primary Examiner*—Andres Kashnikow
*Assistant Examiner*—Jorge Bocanegra
*Attorney, Agent, or Firm*—Pepe & Hazard LLP

[57] ABSTRACT

A modular abrasive agent water jet cutting head (1) has a nozzle (4) issuing a high-speed water jet (16), a mixing chamber (10) through which the high speed water jet passes (16), an abrasive agent supply line (14), and a focussing nozzle (15) forming the outlet of the mixing chamber (10). A dosing unit (12) has an axial passage of the high-speed water jet (16). The passage (18) has one or more expansions or channels (11) extending radially and which are of reduced cross section at the passage. There are preferably in each case are formed as a slits, which are only slightly wider than the diameter of the thickest abrasive particle. The expansion or channel (11) is closely connected to the passage of the high-speed water jet (16) and introduces the abrasive agent into a chordal section of the water jet (16) which is oriented in the direction of the cutting action. From there the high-speed water jet (16) receives a track of abrasive agent on its surface.

5 Claims, 2 Drawing Sheets

MODULAR ABRASIVE MEDIUM WATER JET CUTTING HEAD

BACKGROUND OF THE INVENTION

The invention concerns a modular abrasive agent water jet cutting head with specific abrasive agent additions.

It is known to mix an abrasive agent such as garnet or corundum into the cutting water jet in order to increase the cutting effect of the cutting water jet. For this the abrasive agent in a mixing chamber, through which the water jet flows vertically, is fed to the water jet from the side as uniformly as possible over the entire circumference (EP 221236).

It is known that the mixing chamber can be protected with deposited abrasive agent in order to avoid erosion in the mixing chamber due to the abrasive material, (DE-OS 384434) so that the abrasive agent is washed specifically and directly into the water jet by injection water. In order to reinforce this, the abrasive agent is accelerated at an acute angle (DE-GM 9402916.9) and added to the mixing chamber under pressure (DE-OS 4005691).

In order to protect the focussing nozzle from the effect of the abrasive agent, the cutting jet is surrounded with a water jacket (DE-OS 4005691). For better mixing of the abrasive agent into the water jet it is known to expand the focussing nozzle in funnel-shape on the inlet side (EP 110529).

According to DE-OS 3516103 a cutting jet loaded uniformly with abrasive particles is a condition for a clean, uniform cut. In the case of non-uniform distribution of the particles on one side in the mixing chamber, and thus undirected particle feed to the circumference of the previously described cutting heads flowing through the mixing chamber centrally, there is no uniform particle jet, as is desired. An asymmetrically loaded mixing jet can cause a non-uniform cut and a one-sided wear of the focussing nozzle.

Precise investigations have shown that only the abrasive particles located on the surface in the direction of cut of the mixed jet produce a cutting effect. The abrasive particles located in the interior or on the sides of the jet turned away from the direction of cutting do not produce a cutting effect.

The purpose and task of the invention is to apply abrasive particles on the surface of the cutting jet, in the respective direction of cutting thus in order to increase the cutting power with a reduction of the use of the abrasive agent.

SUMMARY OF THE INVENTION

The knowledge that only the abrasive particles located on the surface of the cutting jet in the direction of cutting are effective leads to the apparatus of the present invention in which the mixing chamber known up to now has inserted thereinto a dosing unit. Extending axially therethrough is an opening for the passage of the cutting jet A laterally extending channel extends radially outwardly therefrom to the abrasive agent supply line. Abrasive particles are introduced into a chordal portion to the surface of the cutting jet to concentrate the abrasive particles in a chordal sector 30° to 60° wide from this channel with a ratio of the diameter of the abrasive particles to that of the cutting beam of approximately 1:4. By turning the cutting head or the dosing unit around the axis of the cutting beam, controlled corresponding to the cutting parameters, the sector loaded with abrasive agent emerges from the focussing nozzle on the side of the cutting beam which is in the direction of cutting. By means of using a dosing unit with several expansions for delivering the abrasive particles distributed uniformly around the cutting beam, of which only the expansion(s) located approximately in the cutting direction is (are) charged with abrasive particles, it is possible to reduce the angle of rotation for the cutting head, or mount the cutting head in a fixed position. In the modular abrasive agent water jet cutting head there is an adjusting element, with which these parts can be adjusted individually and/or completely for securing the alignment of the jet-guiding elements and thus for assuring a collimation of the jet-forming head components.

BRIEF DESCRIPTION OF THE DRAWINGS

The invention is to be explained in greater detail below by means of an embodiment. The respective drawing shows in FIG. 1 a longitudinal section through a modular cutting head in principle, FIG. 2 a dosing unit in the longitudinal section, FIG. 3 a dosing unit in cross-section.

DETAILED DESCRIPTION OF THE ILLUSTRATED EMBODIMENT

Figure 1:
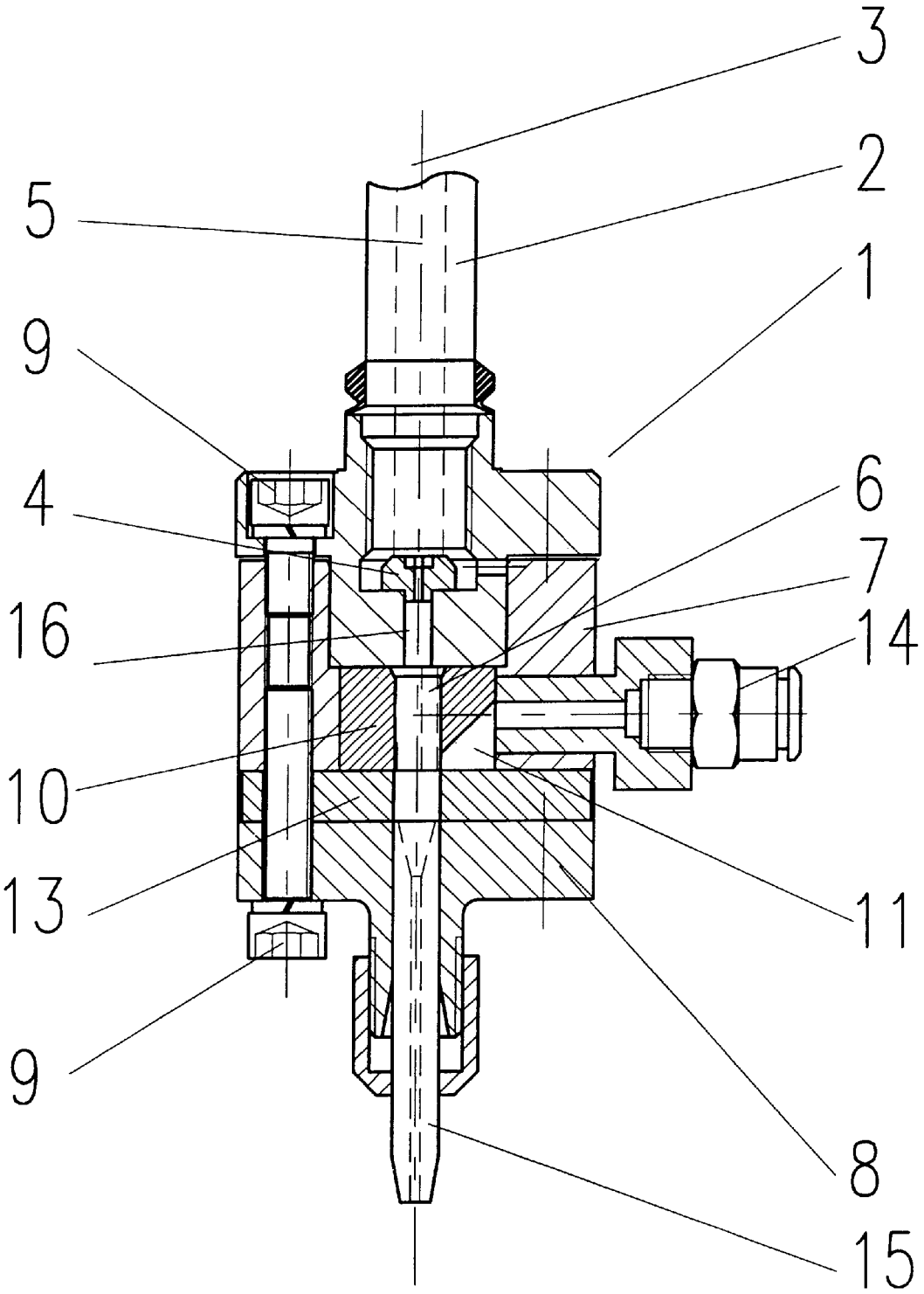
Figure 2:
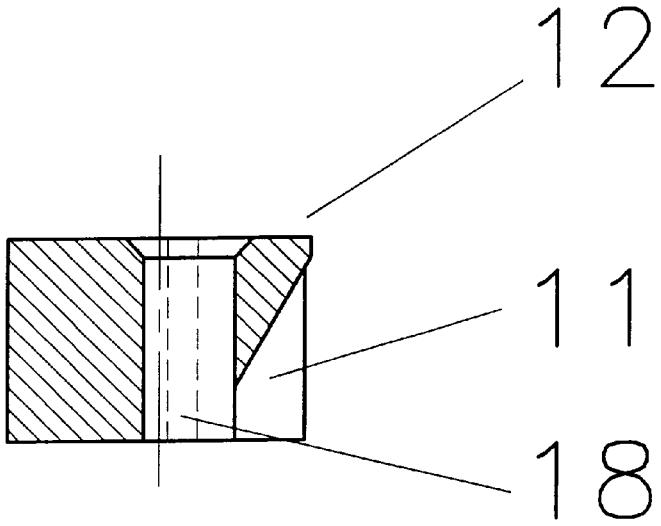
Figure 3:
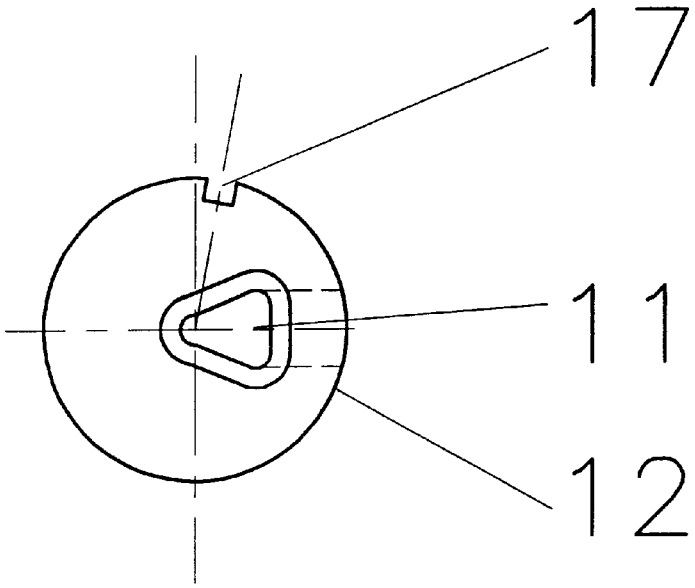

A modular cutting head 1 is connected to a collimation pipe 2 with a high-pressure connection 3. There is a nozzle orifice 4 in front of the end of the collimator pipe 2. A central channel 6 passes through the entire modular cutting head 1 along the middle axis thereof, starting from the nozzle orifice 4. The modular cutting head 1 is enclosed by a housing 7, which is closed with a focussing nozzle holder 8. The modular cutting head 1 is held with screws 9.

In the interior of the housing 7 there is a mixing chamber 10, which contains a dosing unit 12 provided with an axial passage 18 for the jet, a radially extending expansion or channel 11. The dosing unit 12 is positioned in the mixing chamber 10 with a spacer 13. An abrasive agent supply line 14 opens laterally into the mixing chamber 10. The channel 11 is located in front of the abrasive agent supply line 14. A focussing nozzle 15 held by the focussing nozzle holder 8 is connected in the axial direction of the modular cutting head 1. A high-speed water jet 16 generated by the nozzle orifice 4 flows through the modular cutting head 1 in the central channel 6 in the axial direction along the middle axis 5. A stream of abrasive agent is introduced to a chordal section of the cross section of the high-speed water jet. For this there is a passage 18 in the middle of the dosing unit 12, which is fixed by means of a groove 17. The hole 18 has a diameter corresponding approximately to the diameter of the high-speed water jet 16. The wall of the passage 18 is bisected by the channel 11. The abrasive agent is applied only to the chordal section of the high-speed water jet 16 located in front of the expansion 11. The modular cutting head 1 is turned during cutting so that at the outlet of the focussing nozzle 15, the water set sector with the abrasive agent always emerges on the side of the high-speed water jet 16 located in the direction of cutting.

Having thus described the invention, what is claimed is:

1. In a modular abrasive agent water jet cutting head (1) having a nozzle (4) for issuing a high-speed water jet (16), a mixing chamber (10) through which the high-speed water jet (16) passes, an abrasive agent supply line (14) and a focussing nozzle (15) forming the outlet of the mixing chamber (10), the improvement comprising; a dosing unit (12) in the mixing chamber (10) and having an axial passage (18) for the high-speed water jet (16) to pass therethrough, said dosing unit (12) having a lateral channel (11) extending radially from said axial passage for the high-speed water jet (16) to said abrasive agent supply line and through which a stream of abrasive agent from said supply line (14) may be introduced, said radial passage narrowing in cross section from said supply line to said axial passage to introduce the abrasive agent into a chordal portion of the high-speed water jet (16) located in the cutting direction.

2. The modular abrasive agent water jet cutting head (1) in accordance with claim 1,.wherein said lateral channel (11) narrows to a slit at said axial passage which is only slightly wider than the diameter of the thickest particle of abrasive agent to be fed therethrough.

3. The modular abrasive agent water jet cutting head (1) in accordance with claim 1, wherein said cutting head (1) is rotatable about the axis of the high-speed water jet (16).

4. The modular abrasive agent water jet cutting head (1) in accordance with claim 1, wherein said dosing unit (12) is rotatable around the axis of the high-speed water jet (16).

5. The modular abrasive agent water jet cutting head (1) in accordance with claim 1, wherein said dosing unit (12) has an axial guide groove (17) in its periphery to orient said lateral channel in said cutting head.

* * * * *